US010495264B2

(12) United States Patent
Eckert et al.

(10) Patent No.: US 10,495,264 B2
(45) Date of Patent: Dec. 3, 2019

(54) ROTATEABLE ENDCAP / BASE FOR TUBE LAMPS

(71) Applicant: LEDVANCE GmbH, Garching bei München (DE)

(72) Inventors: Klaus Eckert, Herbrechtingen (DE); Bernd Pilhoefer, Graben (DE); Florian Wagner, Regensburg (DE)

(73) Assignee: LEDVANCE GMBH, Garching bei München (DE)

( * ) Notice: Subject to any disclaimer, the term of this patent is extended or adjusted under 35 U.S.C. 154(b) by 0 days.

(21) Appl. No.: 16/118,534

(22) Filed: Aug. 31, 2018

(65) Prior Publication Data

US 2019/0063690 A1 Feb. 28, 2019

(30) Foreign Application Priority Data

Aug. 31, 2017 (DE) ..... 10 2017 120 067

(51) Int. Cl.

| | |
|---|---|
| ***F21K 9/235*** | (2016.01) |
| ***F21V 23/06*** | (2006.01) |
| ***F21V 17/12*** | (2006.01) |
| ***F21V 23/00*** | (2015.01) |
| ***F21K 9/237*** | (2016.01) |
| ***F21K 9/238*** | (2016.01) |
| ***F21V 17/18*** | (2006.01) |
| *F21Y 115/10* | (2016.01) |

(52) U.S. Cl.

CPC ..... *F21K 9/235* (2016.08); *F21K 9/237* (2016.08); *F21K 9/238* (2016.08); *F21V 17/12* (2013.01); *F21V 17/18* (2013.01); *F21V 23/006* (2013.01); *F21V 23/06* (2013.01); *F21Y 2115/10* (2016.08)

(58) Field of Classification Search

CPC ..... F21K 9/235; F21K 9/237; F21K 9/238; F21V 23/06; F21V 17/12; F21V 17/18

See application file for complete search history.

(56) References Cited

U.S. PATENT DOCUMENTS

2011/0085335 A1 4/2011 Osawa

FOREIGN PATENT DOCUMENTS

| | | |
|---|---|---|
| DE | 212015000210 U1 | 4/2017 |
| EP | 3032164 A1 | 6/2016 |
| JP | 2008181679 A | 8/2008 |

*Primary Examiner* — Joseph L Williams

(74) *Attorney, Agent, or Firm* — Hayes Soloway PC

(57) ABSTRACT

A lamp includes a base with at least two electrical connecting elements. A bulb is rotatably mounted relative to the base. A light engine is arranged in the bulb with at least one light-emitting element and an electrically conductive substrate on which the light-emitting element is arranged. An electronic driver is connected to the electrically conductive substrate for activation of the light-emitting element. The base has a base sleeve in which the electronic driver is arranged. The electrically conductive substrate has a flexible connecting section between the electronic driver and the light-emitting element.

13 Claims, 3 Drawing Sheets

ROTATEABLE ENDCAP / BASE FOR TUBE LAMPS

CROSS-REFERENCE TO RELATED APPLICATIONS AND PRIORITY

This patent application claims priority from German Patent Application No. 102017120067.3 filed Aug. 31, 2017, which is herein incorporated by reference in its entirety.

TECHNICAL FIELD

The present invention relates to a lamp with a base and a bulb rotatably connected to the base. In particular the present invention relates to retrofit LED tube lamps.

BACKGROUND

Conventional fluorescent tubes (low-pressure discharge lamps, for example the models T5 and T8) by their nature emit generated light in all directions around the longitudinal axis of the tube. Because retrofit tube lamps in LED technology have LEDs arranged in a line, these lamps generally have a limited emission angle which is determined by the emission characteristic of the LEDs.

In order to enable a targeted emission of the light depending upon the application, there are retrofit LED tube lamps in which the lamp bases (also referred to as end caps) are configured rotatably relative to the tube bulb, in which the light engine, i.e. the arrangement of the LEDs on a substrate which holds the LEDs, mechanically and simultaneously enables the supply of electrical power to the LEDs. An electronic driver (also referred to below simply as a driver) is usually used, which provides an appropriate power supply for the LEDs from the available mains voltage. In this case it must be ensured that there is a secure electrical connection of the connecting pins in the end caps to the driver, since the mains voltage is still available at this point. Moreover, the torque occurring during installation of the lamp into a socket must be absorbed by the rotary mechanism.

For this purpose, a latching mechanism, which enables the end cap to turn in relation to the tube bulb in defined angular steps, is usually used in the lamp bases. In this case the part of the end cap with the connecting pins is pulled out against a spring, rotated and, after release, is latched again due to the spring action. Such a mechanism has a space requirement of approximately 10 mm, so that the part of the lamp illuminated by the LEDs is reduced in size.

The driver is connected to the connecting pins by means of cables. This connection is loaded in particular by frequent turning. Loosening of or damage to this connection can constitute a safety risk due to the applied mains voltage.

SUMMARY OF THE INVENTION

Starting from the known prior art, it is an object of the present invention to provide an improved lamp.

This object is achieved by a lamp with the features of the independent claim. Advantageous further embodiments are set out in the subordinate claims.

A lamp according to the invention has a base with at least two electrical connecting elements as well as a bulb which is mounted rotatably relative to the base. The electrical connecting elements can be for example connecting pins of a tube lamp. The bulb is preferably translucent, in particular transparent, so that the light generated in the interior of the lamp can penetrate to the outside. The bulb can be made, in particular, from plastic or glass.

For light generation the lamp has a light engine arranged in the bulb with at least one light-emitting element and an electrically conductive substrate on which the light-emitting element is arranged. The light-emitting element can be a light-emitting semiconductor element, in particular a light-emitting diode (LED). The light engine preferably has a plurality of light-emitting elements, for example, to achieve a sufficient brightness and to facilitate uniform illumination. The light engine is preferably connected non-rotatably to the bulb, i.e. during a rotation of the bulb relative to the base the light engine also moves correspondingly. In this way the emission direction of the lamp according to the invention can be set relative to a socket.

The electrically conductive substrate is preferably not electrically conductive over the entire surface but has electrically conductive structures (conductive tracks). The electrically conductive substrate can, in particular, be a printed circuit board (PCB).

For activation of the light-emitting element the lamp has an electronic driver which is connected to the electrically conductive substrate. The electronic driver is electrically conductively connected on the input side to the electrical connecting elements and, when supplied with electrical power by means of the electrical connecting elements, provides on the output side an electrical power supply for the light-emitting element with suitable parameters (such as current and voltage).

The electrically conductive substrate can be electrically conductively connected to the electronic driver by means of a plug connection or a soldered connection.

The base of the lamp has a base sleeve, which is rotatably mounted relative to the bulb. The base sleeve can be made, for example, of plastic. The electronic driver is arranged at least partially in the base sleeve. The electronic driver is preferably rotationally fixedly connected to the base sleeve, i.e. when the base sleeve rotates relative to the bulb the electronic driver also moves correspondingly. As a result, a mechanical loading of the electrical connection between the electrical connecting elements fastened to the base sleeve and the driver is avoided. The electronic driver can be connected on the input side to the electrical connecting elements in particular by soldering or crimping.

The electrically conductive substrate has a flexible connecting section between the electronic driver and the light-emitting element. As a result an electrical connection is enabled even in the event of a relative rotation between the bulb with the light engine and the base with the driver.

The electrically conductive substrate is preferably a flexible printed circuit board, for example based on polyimide film with conductive tracks embedded therein or arranged thereon. This allows a flexible electrical connection of the electrically conductive substrate to the driver without interposed additional connecting elements.

In one embodiment the flexible connecting section includes one or more loops of the flexible printed circuit board. For example, the flexible printed circuit board can be guided, starting from the electronic driver, first of all away from the bulb in the direction of the connecting elements and then with a bend (i.e. with a curve of approximately 180°) towards the bulb. By such guiding of the flexible printed circuit board it has been shown that the mechanical loading of the flexible printed circuit board remains low during a relative rotation between the bulb and the base sleeve. Thus, the risk of damage to the flexible printed circuit board can be minimized. Also, no mechanical loading of the flexible printed circuit board takes place in the region in which the light-emitting elements are arranged. Moreover, no electrical rotary feedthroughs are required, in which an electrical contact (for example a sliding contact) is required between two components which are movable relative to one another.

In one embodiment the lamp also has a bearing sleeve which is fixedly connected to the bulb, wherein the base sleeve is rotatably mounted in the bearing sleeve. The bearing sleeve can, for example, be adhered to the bulb by means of adhesive (for example, UV adhesive, silicone adhesive, hot-melt adhesive, etc.) or cement (for example, an adhesive which foams when heated). The bearing sleeve can be configured so that it can securely receive and guide the base sleeve. The bearing sleeve can be made, for example, of plastic. The bearing sleeve can protrude partially into the bulb and can abut the inner wall of the bulb so that a sufficiently large fastening surface is produced without the external diameter of the lamp being increased beyond the bulb diameter.

In one embodiment the base sleeve and the bearing sleeve have corresponding latching elements. The latching elements can serve to prevent twisting of the bearing sleeve and base sleeve (in particular in a specific relative position of the bearing sleeve and the base sleeve). As a result the orientation of the bulb and the base can be fixed and the torque, which usually acts on the bulb during installation of the lamp into a socket, can be transmitted to the base.

In one embodiment the corresponding latching elements have a latching projection (i.e. a latching tooth) on the base sleeve and a plurality of latching recesses (i.e. a tooth structure or row of teeth) corresponding to the latching projection. For example, the latching projection can extend in the longitudinal direction (i.e. along a longitudinal axis of the lamp) along the base sleeve in the direction of the bulb. Accordingly, the resulting teeth between the latching recesses can extend in the longitudinal direction of an outer end of the bearing sleeve in the direction of the base. The width of the individual latching recesses is preferably as great as or only slightly greater than the width of the latching projection. As a result, a secure latching between the base sleeve and the bearing sleeve is possible with only a little play. It may also be provided that the latching projections and/or the latching recesses are configured conically or trapezoidally. As a result, the play between the latching projections and the latching recesses can be further reduced.

In one embodiment the base sleeve and the bearing sleeve can have a rotation angle limiter. The rotation angle limiter can limit the range of the relative rotation between the base sleeve and the bearing sleeve, for example by ±90° about a center position. This can prevent damage to the flexible connecting section of the electrically conductive substrate in the event of excessively strong rotation. For example, the bearing sleeve can have a stop for the latching projection as a rotation angle limiter.

In one embodiment the base sleeve is longitudinally and displaceably mounted in the bearing sleeve. In particular, the base sleeve can be movable relative to the bearing sleeve between a rotational position, in which the base sleeve is rotatable relative to the bearing sleeve, and a fixing position, in which the base sleeve cannot be rotated relative to the bearing sleeve. The fixing position is preferably the position in which the lamp is installed in a socket. This is relevant in particular in the case of tube lamps, since here the available space between the two receiving ends of the socket is precisely fixed. In the fixing position the base sleeve can be inserted into the bearing sleeve as far as a stop. In order to bring the base sleeve into the rotational position in relation to the bearing sleeve, the base sleeve can be pulled out of the bearing sleeve.

The base sleeve preferably has a limiting element for limiting the longitudinal movement of the base sleeve out of the bearing sleeve. As a result, for example, this can prevent the base sleeve from being completely pulled out of the bearing sleeve.

For example, the limiting element can be a projection which is flexibly fastened to the base sleeve, for example a tab in a side wall of the base sleeve, which on one side is connected to the side wall and on three further sides is separated from the side wall. During assembly of the lamp, i.e. for example during insertion of the base sleeve into the bearing sleeve, a flexible projection can be deformed so that assembly is possible.

For this purpose, the tab described above can have a ramp, i.e. an oblique surface directed longitudinally inwards, i.e. towards the bulb, which upon contact with the bearing sleeve ensures that the tab is pressed radially inwards. Towards the exterior, i.e. at the end remote from the bulb, the tab can have a surface which is substantially perpendicular to the side wall of the base sleeve and which, when the base sleeve is pulled out of the bearing sleeve, comes into contact with the bearing sleeve, for example with a collar of the bearing sleeve, and prevents a further movement in this direction.

In one embodiment the base sleeve has a fixing element for releasable fixing of the base sleeve in the bearing sleeve in the longitudinal direction. In particular the fixing element can serve in order to fix the base sleeve relative to the bearing sleeve in the fixing position described above. Thus, the base sleeve is prevented from being moved inadvertently in the longitudinal direction relative to the bearing sleeve, for example during the installation of the lamp into a socket.

For example, the fixing element can be a projection flexibly fastened to the base sleeve, for example a tab in a side wall of the base sleeve, which is connected at one side to the side wall and is separate from the side wall on three further sides. During assembly of the lamp, i.e. for example during insertion of the base sleeve into the bearing sleeve, a flexible projection can be deformed so that assembly is possible.

In contrast to the limiting element described above, the fixing element should not prevent a relative longitudinal movement between the base sleeve and the bearing sleeve but should only oppose specific resistance to such a movement. For this purpose, the tab described above can have a ramp, i.e. an oblique or curvilinear surface which is directed outwards, in other words away from the bulb. Upon contact with the bearing sleeve, for example with a collar of the bearing sleeve, this oblique or curvilinear surface can ensure that, in the event of sufficiently strong force in the longitudinal direction, the tab is pressed radially inwards and the longitudinal movement of the base sleeve in the bearing sleeve is made possible.

The limiting element and the fixing element can both interact with the same location on the bearing sleeve, for example with the same collar. This means that the limiting element and the fixing element can be arranged at the same circumferential position of the base sleeve, but at different longitudinal positions. For example, the limiting element can be arranged further inwards, i.e. closer to the bulb, than the fixing element.

In one embodiment the lamp also has a cover sleeve which is arranged on the bulb so that it covers the bearing sleeve. As a result, the base sleeve and the bearing sleeve can be protected against external influences and the lamp can acquire a more pleasant visual appearance. The cover sleeve can also prevent a radial divergence of the parts of the base sleeve and the bearing sleeve which interact with one another.

The cover sleeve can be made, for example, from plastic or from metal. A cover sleeve made from metal can additionally ensure the temperature resistance during heating of the adhesive or cement by which the bearing sleeve is fastened to the bulb.

The bulb can have a substantially constant external diameter (normal external diameter) over a majority of its longitudinal extent. The bulb can preferably have an external diameter which is reduced by comparison with the normal external diameter at the end of the bulb in the region in which the bearing sleeve and the cover sleeve are located in a finished assembled lamp. In particular, the reduced external diameter in this region can be selected so that the external diameter of the cover sleeve corresponds to the normal external diameter of the bulb. In this way a uniform external diameter of the lamp can be achieved over the entire length of the lamp.

The rotatable connection of the base and the bulb described here can be used both in the case of tube lamps with two bases and also in the case of lamps with only one base (for example an Edison, bayonet or pin (bipin) base).

Although the design of the rotatably mounted base sleeve has been described here in connection with a driver arranged in the base sleeve and in connection with a flexible connection between the driver and the light engine, the present disclosure also covers: alternative configurations of the flexible connection; as well as the case where the base sleeve, rotatably mounted in the bearing sleeve, can also be used independently of a driver arranged in the base sleeve and/or independently of a flexible connection between the driver and the light engine. For example, the driver can be connected non-rotatably to the light engine and the electrical connection between the driver and the connecting elements can take place by means of flexible electrically conductive elements (for example cables).

The design of the base sleeve and the bearing sleeve described here can also be used in a lamp which substantially corresponds to the embodiment disclosed here, but as a flexible electrical connection between the driver and the light engine does not have a flexible connecting section of an electrically conductive substrate, but has cables which are electrically conductively connected both to the driver and also to the light engine.

In particular, the design of the base sleeve rotatably mounted in the bearing sleeve can also be used without a driver. For example, in a tube lamp (for example model T5 or T8) an electronic driver can be provided only at one end of the lamp. A base sleeve rotatably mounted in the bearing sleeve and without a driver can then be used at the other end of the lamp. In this case the electrical connecting elements (connecting pins) can also be replaced by non-conductive retaining elements (retaining tabs). The further statements above apply accordingly.

The rotatable connection of the base and the bulb described here uses fewer individual parts than the known solutions for a rotary mechanism with springs. As a result, the production of a lamp according to the invention is significantly simplified. Furthermore, the rotatable connection described here requires substantially less space than the known solutions. In this way more space is available for the light engine and the unlit region of the lamp is smaller. The visible part of the base sleeve made from plastic can be very short relative to the cover sleeve made from metal. As a result, the lamp looks very similar to a conventional fluorescent tube lamp with a purely metal base.

BRIEF DESCRIPTION OF THE DRAWINGS

Preferred further embodiments of the invention are explained in greater detail by the following description of the drawings. In the drawings.

DETAILED DESCRIPTION

Figure 1:
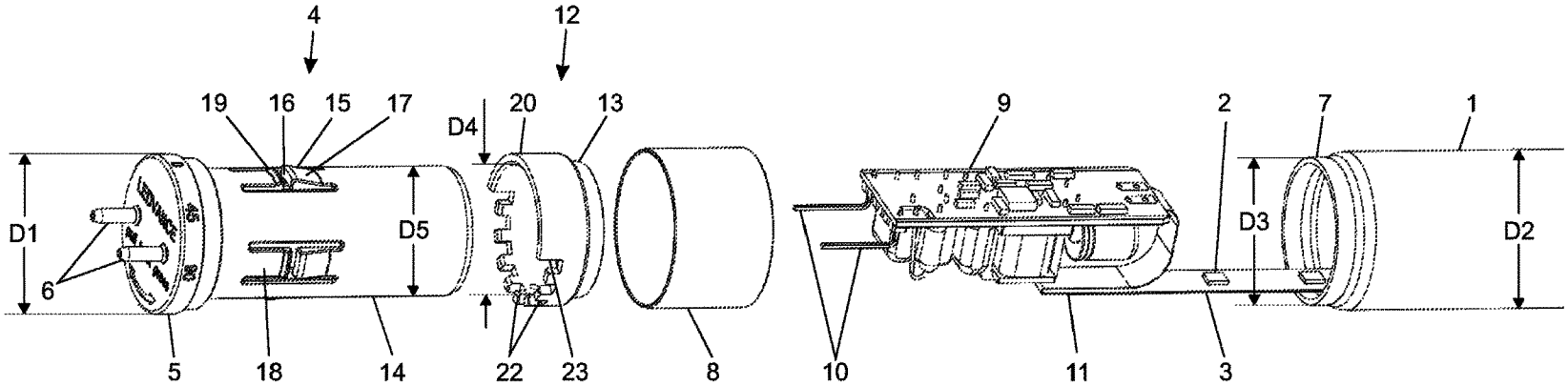
FIG. 1 shows an embodiment of a lamp according to the invention in a perspective exploded view.

Preferred exemplary embodiments are described below with reference to the drawings. In this case elements which are the same, similar, or act in the same way are provided with identical reference numerals in the different drawings, and repeated description of some of these elements is partially omitted in order to avoid redundancies.

Figure 2:
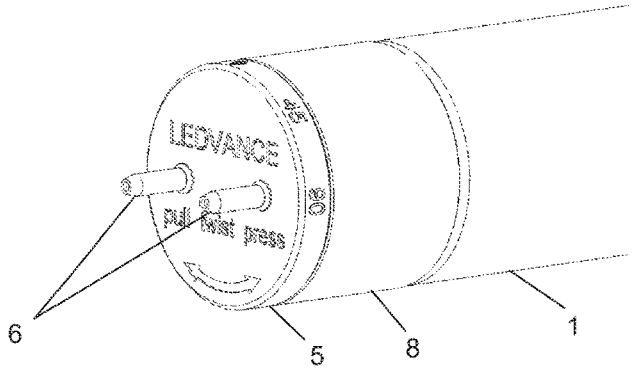
FIG. 2 shows the embodiment according to FIG. 1 in a perspective representation.
Figure 3:
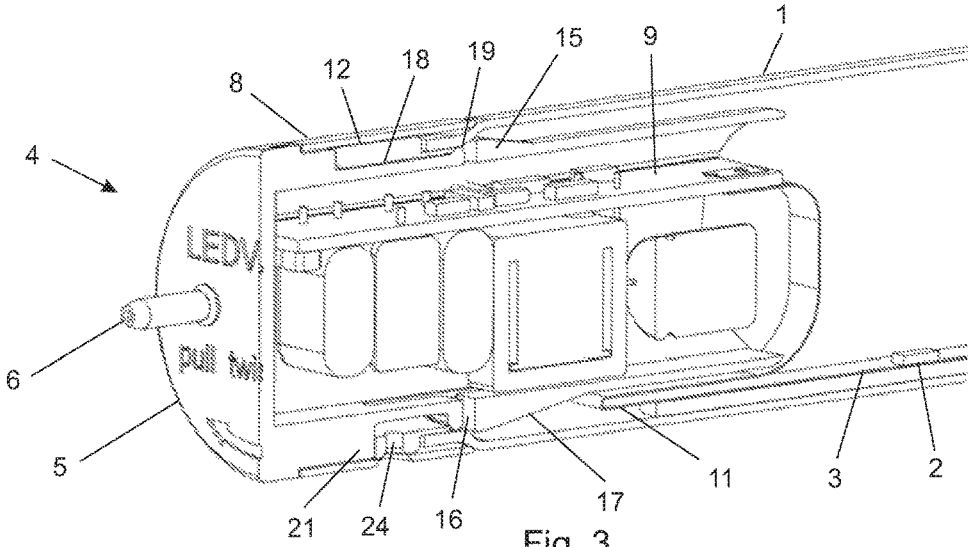
FIG. 3 shows the embodiment according to FIG. 1 in a perspective sectional representation in the fixing position.
Figure 4:
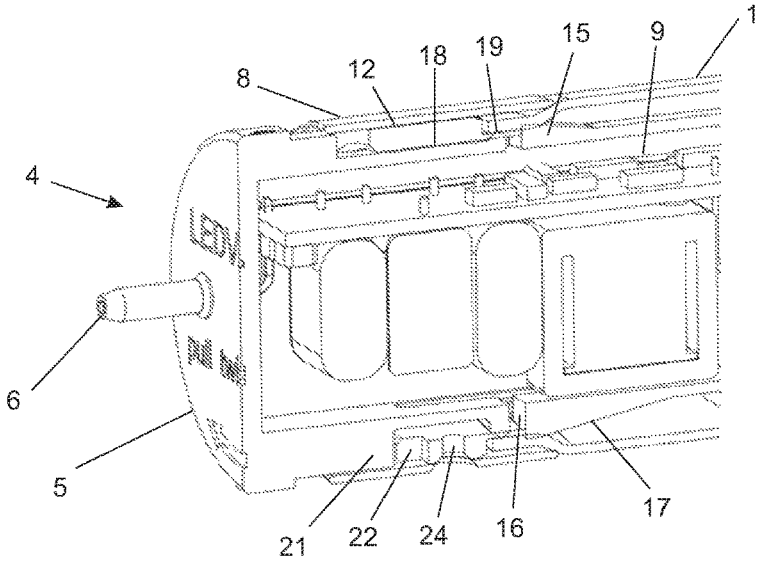
FIG. 4 shows the embodiment according to FIG. 1 in a perspective sectional representation in the rotation position.

An embodiment of a lamp according to the invention is shown schematically in FIGS. 1 to 6 in different representations and positions. Only one end of the lamp is shown in each drawing. FIG. 1 shows a perspective exploded view of the individual components of the lamp. In FIG. 2 the lamp is illustrated in the assembled state, specifically in the fixing position, i.e. the end cap is not rotatable. FIGS. 3 and 4 show the lamp in a perspective sectional representation, in one case in the fixing position (FIG. 3) and in one case in the rotation position (FIG. 4), in which the end cap is rotatable.

The lamp has a translucent (for example matte) bulb 1, preferably made from glass or plastic, in which a light engine is arranged. The light engine has a plurality of light-emitting diodes (LEDs) 2, which are arranged on a flexible printed circuit board 3. The printed circuit board 3 extends along the bulb 1 and is fastened to the inner side of the bulb 1. The printed circuit board 3 can be fastened to the bulb 1 by means of adhesive.

The bulb 1 is closed off at its open end by a base sleeve 4. The base sleeve 4 has on the end face an end section 5 on which two connecting pins 6 are fastened. The external diameter D1 of the end section 5 is substantially the same as the normal external diameter D2 of the bulb 1.

The end region 7 of the bulb 1 has a reduced external diameter D3, so that the cover sleeve 8 which is arranged over this end region 7 can have an external diameter D4 which is substantially the same as the normal external diameter D2 of the bulb 1.

An electronic driver 9 (also referred below simply as the driver 9) is arranged in the interior of the base sleeve 4. The driver 9 is electrically conductively connected by means of connecting wires 10 to the connecting pins 6, wherein the connecting wires 10 are introduced into the connecting pins 6 and then the connecting pins 6 are crimped. As a result the driver 9 is connected non-rotatably to the base sleeve 4.

The flexible printed circuit board 3 is guided by means of a flexible connecting section 11 which makes a loop, i.e. a region in which it is initially guided longitudinally outwards and then—following a 180° curve—again inwards to the electronic driver 9 and is connected thereto (for example a plug-in or soldered connection). The flexible connecting section 11 enables a rotation of the driver 9 during a rotation of the base sleeve 4 without, in this case, moving the flexible printed circuit board 3 in the region in which the LEDs 2 are mounted thereon.

A bearing sleeve 12 which protrudes with a collar 13 into the bulb 1 is adhered to the end of the bulb 1. An internal diameter D4 of the bearing sleeve 12 corresponds substantially to an external diameter D5 of an inner section 14 of the base sleeve 4. In this way the base sleeve 4 can be introduced with the inner section 14 into the bearing sleeve 12 and is retained and guided there by the latter substantially without play. In this way a rotation of the base sleeve 4 in the bearing sleeve 12 is possible.

A screw (not illustrated) can be introduced into a corresponding screw hole 24 is connected to the bearing sleeve 12 by the cover sleeve 8.

Figure 7:
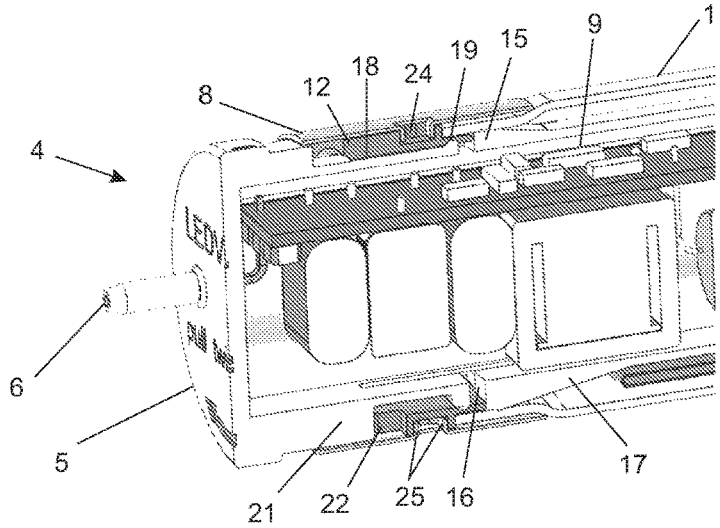
FIG. 7 shows an embodiment of a lamp according to the invention in a perspective sectional representation in the rotation position.

The cover sleeve 8 can also be connected to the bearing sleeve 12 by means of two radially inwardly curved retaining tabs 25 which engage in a cutout 26 in the bearing sleeve 12. This embodiment is illustrated in FIG. 7, which otherwise corresponds to FIG. 4.

Instead of the illustrated possible fastening arrangements with a screw or with two pairs of retaining tabs 25, a different number of screws or retaining tabs can also be used. Likewise, instead of the illustrated embodiment with pairs of retaining tabs, it is also possible to use in each case only one individual retaining tab (optionally at each fastening position) which engages in a cutout. The possible fastening arrangements can also be combined with one another.

A resiliently flexible limiting tab 15 serves as a limiting element and prevents the base sleeve 4, after it has been inserted completely into the bearing sleeve 12, from being completely pulled out again from the bearing sleeve 12. For this purpose, the limiting tab 15 is connected at a longitudinally inner end to the base sleeve 4 and has a projection 19, which in the unloaded state, extends radially outwards over the external diameter D5 of the inner section 14 of the base sleeve 4. The illustrated embodiment has four fastening tabs 15 distributed along the circumference of the base sleeve 4. However, a different number (e.g. 1, 2, 3, 5, or more) of limiting tabs 15 can also be used.

A stop face 16, which extends substantially perpendicularly to the wall of the inner section 14, is located at the free end of the limiting tab 15. During a longitudinal movement of the base sleeve 4 out of the bearing sleeve 12, this stop face 16 can engage with the collar 13 of the bearing sleeve 12 and can prevent a further movement in this direction. This state is shown in particular in FIG. 4.

Towards the interior, i.e. in the direction of the end connected to the base sleeve 4, the limiting tab 15 has an inclination 17 which extends substantially from the upper end of the stop face 16 to the outer surface of the inner section 14 of the base sleeve 4. This inclination 17 enables the base sleeve 4 to be pushed into the bearing sleeve 12, since due to the inclination 17 the limiting tab 15 is pressed inwards upon contact with the inner face of the bearing sleeve 12. If the base sleeve 4 is inserted so far into the bearing sleeve 12 that the limiting tab 15 is no longer in contact with the inner face of the bearing sleeve 12, the resilience of the limiting tab 15 ensures that the bearing sleeve 12 again moves radially outwards into the unloaded position.

In order to prevent an involuntary longitudinal movement of the base sleeve 4 in the bearing sleeve 12 (in particular if the base sleeve 4 is inserted completely, i.e. as far as the stop, into the bearing sleeve 12), the base sleeve also has a resiliently flexible fixing tab 18 which serves as a fixing element. The illustrated embodiment has four fixing tabs 18 distributed along the circumference of the base sleeve 4. However, a different number (e.g. 1, 2, 3, 5, or more) of fixing tabs 18 can also be used.

The fixing tab 18 is connected at a longitudinally outer end to the base sleeve 4 and has a projection 19 which in the unloaded state extends radially outwards over the external diameter D5 of the inner section 14 of the base sleeve 4. The projection 19 is, in particular, chamfered or rounded towards the outside so that, during a longitudinal movement of the base sleeve 4, although the projection 19 can engage with the collar 13 of the bearing sleeve 12, it does not prevent the longitudinal movement, but merely makes it more difficult. In the event of a sufficiently strong force in the longitudinal direction, the projection 19 and thus the fixing tab 18 is pressed radially inwards and thereby frees the longitudinal movement of the base sleeve 4 relative to the bearing sleeve 12. The position of the projection 19 is such that the projection 19 is located inside the collar 13 when the base sleeve 4 is completely pushed into the bearing sleeve. In this position the resilience of the fixing tab 18 ensures that the bearing sleeve again moves radially outwards into the unloaded position. This state is shown in particular in FIG. 3.

As a result the base sleeve 4 is fixed in this position relative to the bearing sleeve 12 and cannot move inadvertently. Nevertheless, this fixing can be overcome by a user and the base sleeve 4 can be pulled out of the bearing sleeve 12 until this movement is ended by the contact between the limiting tab 15 and the collar 13.

The position in which the base sleeve 4 is completely inserted into the bearing sleeve 12 is determined by a further end section collar 20 at the outer end of the bearing sleeve 12 which can engage with the end section 5 of the base sleeve 4 and thereby prevents a further movement of the base sleeve 4 into the bearing sleeve 12.

Thus the base sleeve 4 is movable longitudinally with respect to the bearing sleeve 12 between a first, inner position and a second, outer position. In the inner position, which is illustrated in particular in FIG. 6, a rotation of the base sleeve 4 relative to the bearing sleeve 12 is prevented by a locking tooth 21 on the base sleeve 4 engaging in a row of teeth having a plurality of teeth 22 on the bearing sleeve 12. In this case the dimension of the locking tooth 21 in the circumferential direction (width) corresponds substantially to the spacing between two teeth 22 of the row of teeth, so that the locking tooth 21 is retained between the two teeth 22 substantially without clearance.

In order to be able to rotate the base sleeve 4 relative to the bearing sleeve 12 (and thus to the bulb 1), the base sleeve 4 is pulled out longitudinally from the bearing sleeve 12 into the outer position. This is illustrated in particular in FIG. 5. In this position the locking tooth 21 no longer engages in the row of teeth 22, so that a rotation of the base sleeve 4 is possible. Two rotary stops 23 on the bearing sleeve 12 delimit the rotational angle range provided (for example ±90°), by engaging in each case with the locking tooth 21 at the end of this region and preventing a further rotary movement in the respective direction.

Figure 5:
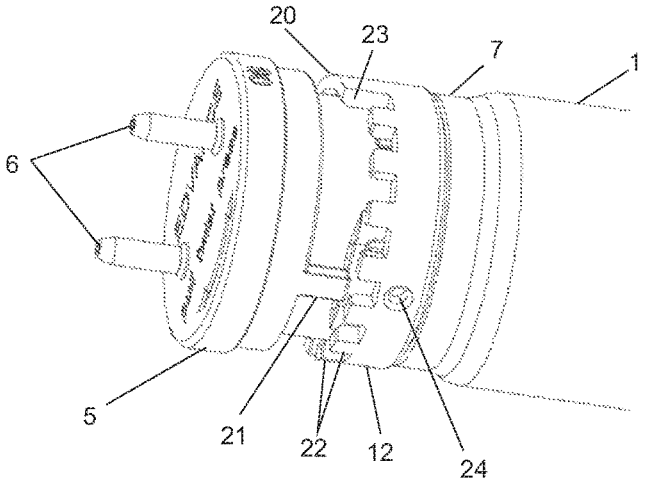
FIG. 5 shows the embodiment according to FIG. 1 in a perspective representation in the rotation position.
Figure 6:
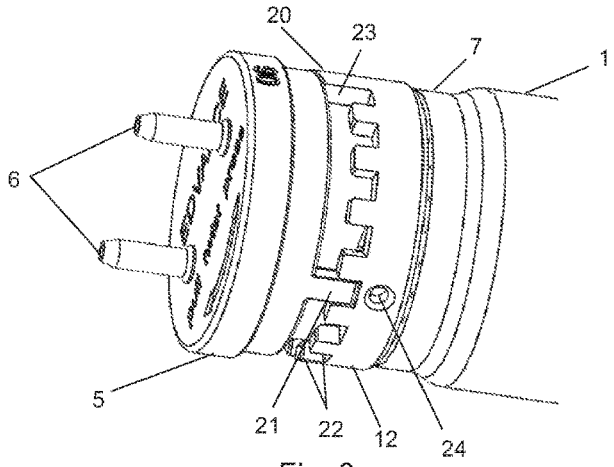
FIG. 6 shows the embodiment according to FIG. 1 in a perspective representation in the fixing position.

FIGS. 5 and 6 show the lamp in a perspective representation, but without the cover sleeve 8, in order to illustrate the mode of operation of the rotary mechanism more precisely.

The base sleeve 4 and the bearing sleeve 12 are preferably made from plastic and can be produced for example in an injection molding process.

Although the invention has been illustrated and described in greater detail by the depicted exemplary embodiments, the invention is not restricted thereto and other variations can be deduced therefrom by the person skilled in the art without departing from the scope of protection of the invention.

In general "a" or "an" may be understood as a single number or a plurality, in particular in the context of "at least one" or "one or more" etc., provided that this is not explicitly precluded, for example by the expression "precisely one" etc.

Also, when a number is given this may encompass precisely the stated number and also a conventional tolerance range, provided that this is not explicitly ruled out.

If applicable, all individual features which are set out in the exemplary embodiments can be combined with one another and/or exchanged for one another, without departing from the scope of the invention.

LIST OF REFERENCES

1 bulb
2 LEDs
3 flexible circuit board
4 base sleeve
5 end section of the base sleeve
6 connecting pins
7 end region of the bulb
8 cover sleeve
9 electronic driver
10 connecting wires
11 flexible connecting section
12 bearing sleeve
13 collar
14 inner section of the base sleeve
15 limiting tab
16 stop face
17 inclination
18 fixing tab
19 projection
20 end section collar
21 locking tooth
22 teeth of the row of teeth
23 rotary stops
24 screw hole
25 retaining tabs
26 cutout
D1 external diameter of the end section of the base sleeve
D2 normal external diameter of the bulb
D3 reduced external diameter of the end section of the bulb
D4 internal diameter of the bearing sleeve
D5 external diameter of an inner section of the base sleeve

The invention claimed is:

1. A lamp comprising:

a base comprising at least two electrical connecting elements and a base sleeve;

a bulb mounted rotatably relative to the base;

a light engine arranged in the bulb comprising at least one light-emitting element and an electrically conductive substrate on which the light-emitting element is arranged; and an electronic driver arranged in the base sleeve and connected to the electrically conductive substrate for activation of the light-emitting element;

wherein the electrically conductive substrate has a flexible connecting section between the electronic driver and the light-emitting element.

2. The lamp according to claim 1, wherein the electrically conductive substrate is a flexible printed circuit board.

3. The lamp according to claim 1, wherein the flexible connecting section comprises at least one loop of a flexible printed circuit board.

4. The lamp according to claim 1, further comprising a bearing sleeve, wherein the bearing sleeve is fixedly connected to the bulb, and wherein the base sleeve is rotatably mounted in the bearing sleeve.

5. The lamp according to claim 4, wherein the base sleeve and the bearing sleeve have at least one corresponding latching element.

6. The lamp according to claim 4, wherein the base sleeve further comprises a latching projection, wherein the bearing sleeve further comprises a plurality of latching recesses engageable with the latching projection.

7. The lamp according to claim 4, wherein the base sleeve and the bearing sleeve have a rotation angle limiter.

8. The lamp according to claim 4, wherein the base sleeve is longitudinal-displaceably mounted in the bearing sleeve.

9. The lamp according to claim 8, wherein the base sleeve has a limiting element for limiting the longitudinal movement of the base sleeve out of the bearing sleeve.

10. The lamp according to claim 9, wherein the limiting element has a projection flexibly fastened to the base sleeve.

11. The lamp according to claim 8, wherein the base sleeve has a fixing element for releasable fixing of the base sleeve in the bearing sleeve in the longitudinal direction.

12. The lamp according to claim 11, wherein the fixing element has a projection flexibly fastened to the base sleeve.

13. The lamp according to claim 4, further comprising a cover sleeve arranged on the bulb and covering the bearing sleeve.

* * * * *